United States Patent [19]

McGrew

[11] 4,336,889

[45] Jun. 29, 1982

[54] RING SUPPORTED TRUCK CRANE AND METHOD OF SETTING UP

[75] Inventor: Bernard L. McGrew, Cedar Rapids, Iowa

[73] Assignee: FMC Corporation, Chicago, Ill.

[21] Appl. No.: 200,844

[22] Filed: Oct. 27, 1980

[51] Int. Cl.[3] ..... B66C 23/78; B66C 23/26

[52] U.S. Cl. ..... 212/178; 212/179; 212/189; 212/244; 212/245; 212/248; 212/270; 254/87; 280/638

[58] Field of Search ..... 212/175, 178, 179–181, 212/189, 244, 245, 247, 248, 253, 254, 270; 254/87; 280/638

[56] References Cited

U.S. PATENT DOCUMENTS

| | | |
|---|---|---|
| 1,237,022 | 8/1917 | Craig . |
| 1,596,156 | 8/1926 | Craig . |
| 1,653,247 | 12/1927 | Zollinger . |
| 1,749,101 | 3/1930 | Heltzel . |
| 1,953,442 | 4/1934 | Sorescu et al. . |
| 2,147,187 | 2/1939 | Bailey . |
| 2,156,582 | 5/1939 | Carlini . |
| 2,235,595 | 3/1941 | Stein . |
| 2,428,163 | 9/1947 | Hubbard et al. . |
| 2,781,002 | 2/1957 | Talboys . |
| 2,967,045 | 1/1961 | Axman . |
| 3,045,972 | 7/1962 | Thomas . |
| 3,239,019 | 3/1966 | Ida . |
| 3,528,675 | 9/1970 | Brown . |
| 3,777,898 | 12/1973 | Gallay . |
| 3,878,944 | 4/1975 | Beduhn ..... 212/189 |
| 3,881,426 | 5/1975 | Long . |
| 4,016,688 | 4/1977 | Tiffin . |
| 4,053,058 | 10/1977 | Jensen et al. . |
| 4,196,816 | 4/1980 | Dvorsky . |

FOREIGN PATENT DOCUMENTS

| | | |
|---|---|---|
| 1258054 | 1/1968 | Fed. Rep. of Germany . |
| 2554910 | 6/1977 | Fed. Rep. of Germany . |

*Primary Examiner*—Robert G. Sheridan

*Attorney, Agent, or Firm*—A. J. Moore; R. B. Megley

[57] ABSTRACT

A ring supported, self-propelled truck crane and method of operation is disclosed wherein a boom is mounted on the chassis for pivotal movement only about a horizontal axis. The chassis is driven into an incomplete segmented ring set up at a working site with rollers on end portions of the chassis projecting downwardly and overlying the ring when the ring opening is closed by adding an additional segment thereto. The ring is then elevated to lift the wheels of the chassis completely off the ground and drive means interconnect the ring and the chassis to rotate the chassis about the vertical axis of the ring. Flanged rollers journaled on the chassis engage the ring to center the chassis on the ring and to rotatably interconnect and support the ring on the chassis for transportation therewith to the next site when the ring and chassis are lowered for support entirely upon the wheels of the truck crane. The preferable embodiment includes a front wheel drive permitting working of the crane on a small diameter ring when retracted and permitting extension of the crane's wheel base during transport to comply with road weight/wheel base laws.

22 Claims, 12 Drawing Figures

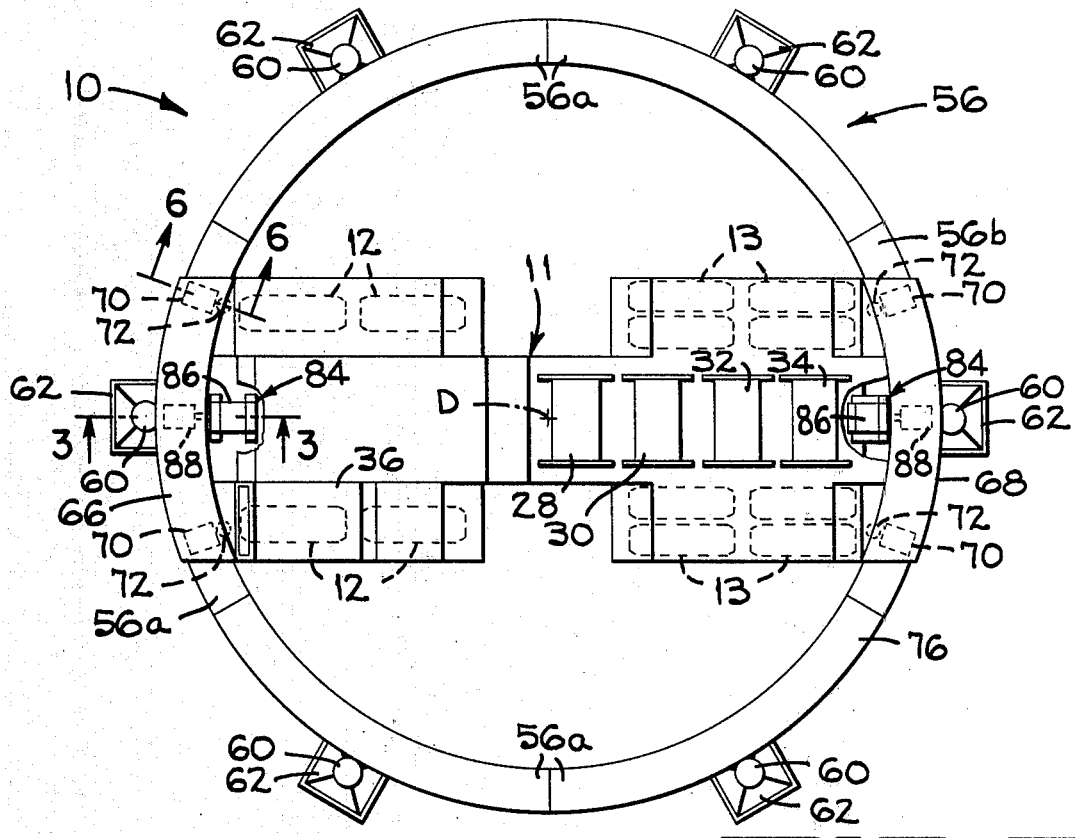
FIG_2
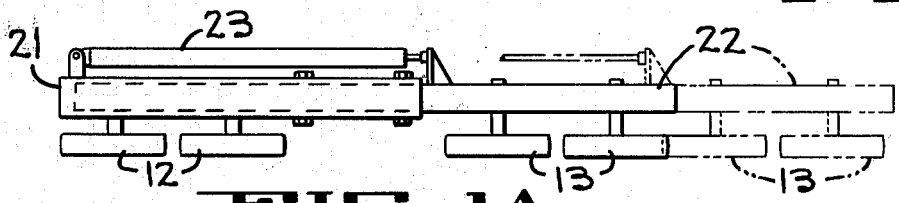
FIG_1A
FIG_3
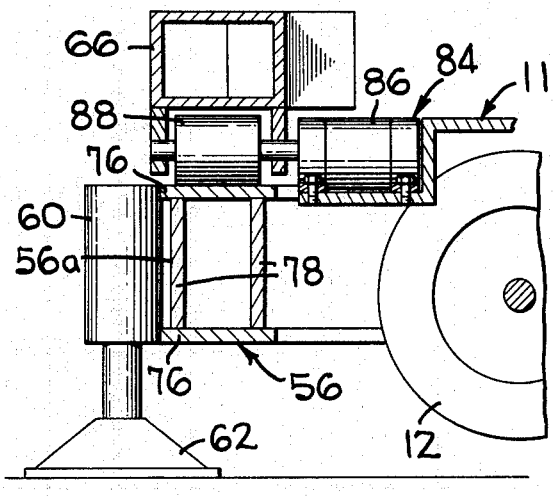
FIG_3A
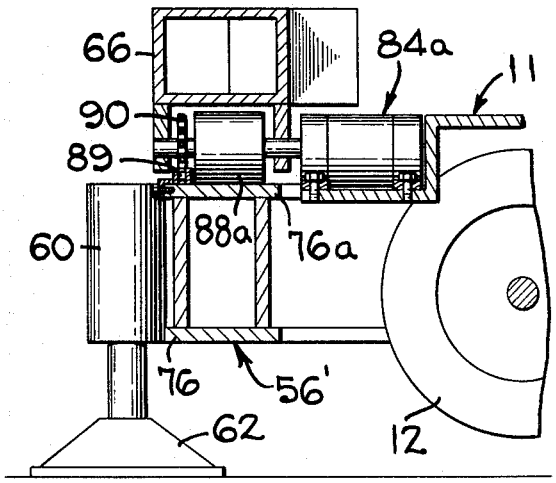

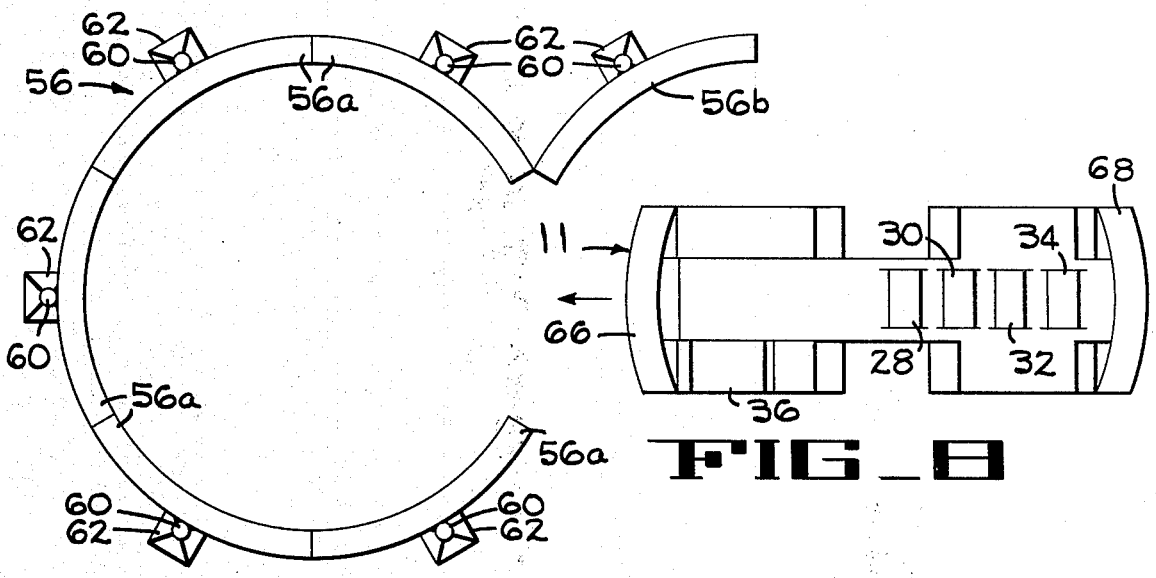
FIG_8
FIG_9
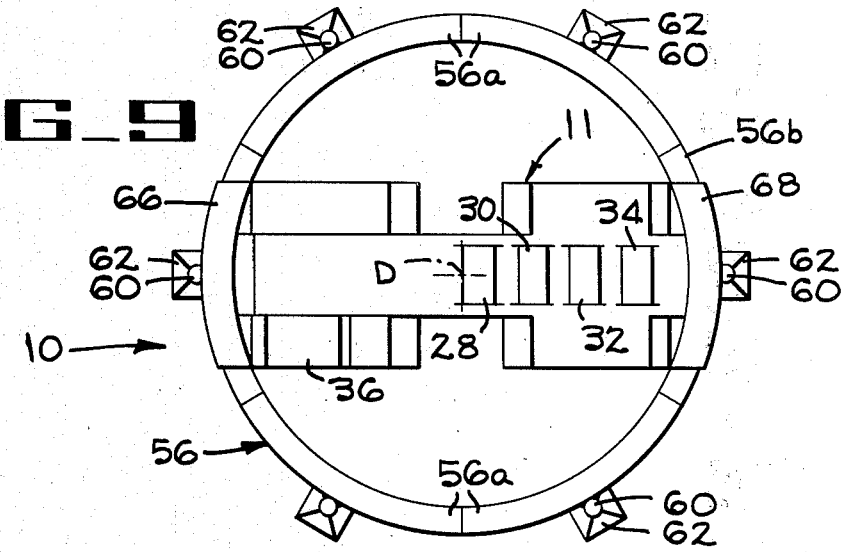
FIG_10
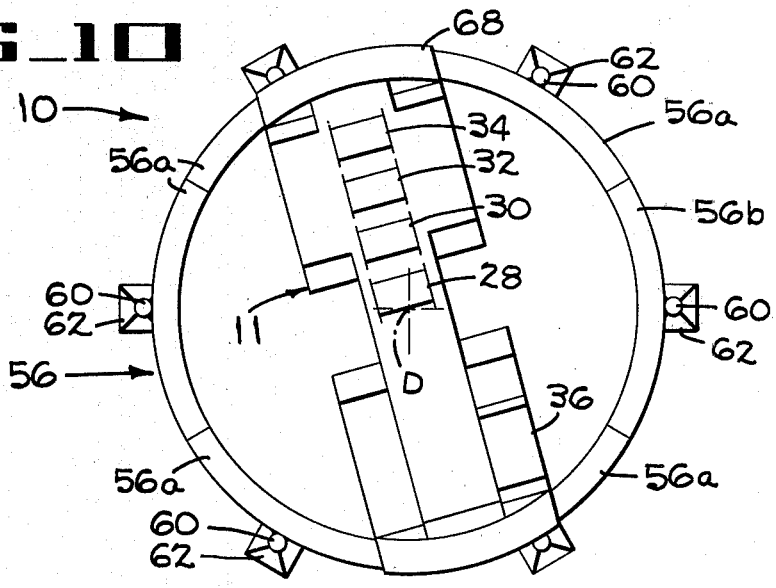

RING SUPPORTED TRUCK CRANE AND METHOD OF SETTING UP

BACKGROUND OF THE INVENTION

1. Field of the Invention

The present invention relates to cranes, and more particularly relates to a mobile truck crane having a boom and other components connected to its chassis for pivotal movement only about a horizontal axis relative to the chassis; said chassis having its end portions rotatably supported on a ground supported ring with the entire chassis raised above the ground and selectively pivoted about a vertical axis concentric with the ring during operation.

2. Description of the Prior Art

Self-propelled truck cranes having a chassis mounted on wheels or crawler tracks with an upper works and boom supported on the chassis for pivotal movement about a vertical axis relative to the chassis are well known in the art. U.S. Pat. No. 4,053,058 to Jensen et al which issued on Oct. 11, 1977; and U.S. Pat. No. 4,016,688 to Tiffin et al which issued on Apr. 12, 1977 disclose cranes which have upper works pivoted about vertical axes.

German Pat. No. 2,554,910 which was published on June 6, 1977 discloses a truck crane with the upper works eliminated so that the chassis or lower works supports the drive motor, hydraulic motors and other standard crane components including the lower end of the jib or live mast which is pivoted to the chassis for vertical movement about a horizontal axis by a hydraulic cylinder. A multisection ground supported ring is placed at the working site with one section being removed so that the crane can be driven within and centered relative to the ring. The removed section is replaced to define a completed ring; and hydraulic jacks are then operated to lift the crane chassis and wheels off the ground. A front end piece and a rear end piece, with ring engaging rollers journaled thereon, are then secured to the chassis ends for supporting the boom for horizontal pivotal movement and for supporting a counterweight, respectively. The jacks are then lowered so that the entire crane is supported by the ring and is selectively rotated about a vertical axis by front and rear hydraulically driven pinions which mesh with a ring gear secured to the ring. Thus, this patented structure necessitates the connection of two end pieces to the chassis after the chassis has first been centered relative to the ring and raised above the ring, and then requires that the ring engaging rollers be lowered onto the ring before the crane can be placed in operation.

U.S. Pat. No. 3,528,675 which issued to Brown on Sept. 15, 1970; and U.S. Pat. No 3,777,898 to Gallay which issued on Dec. 11, 1973 each disclose a mobile crane which carries a turntable and outriggers with cooperating jacks which lift the wheels of the vehicle off the ground permitting the chassis and supported components to be rotated about a vertical axis by a powered pinion and ring gear assembly.

U.S. Wittman et al application Ser. No. 138,461 which was filed on Apr. 4, 1980 and is assigned to the assignee of the present invention, is somewhat pertinent in that the boom, its load, and the counterweight are supported by a ground supported ring. However, the crane differs from the crane of the present invention since it includes an upper works rotatable about a lower works, and since the tracks (or wheels) which support the lower works remain on the ground at all times.

Assignee's Dvorsky et al U.S. Pat. No. 4,196,816 which issued on Apr. 8, 1980 includes a ring that is supported on jacks which support the load and counterweight during operation. However, this patent differs from that of the present invention since it includes a lower works which pivotally supports and drives an upper works about a vertical axis, and the track (or wheels) are not rotated relative to the ring but are anchored thereto during operation.

SUMMARY OF THE INVENTION

The ring supported truck crane of the present invention includes a chassis supported by ground engaging transporting members illustrated as wheels. The chassis supports the usual crane components including a boom at its front end and a counterweight at the rear end, but does not include an upper works that is rotatable about a vertical axis. In order to accommodate movement of the chassis and boom about a vertical axis, rollers are journaled on the front and rear ends of the chassis and ride on a ring which is elevated by a plurality of jacks a sufficient distance to raise the chassis and wheels entirely free of the ground. The chassis is maintained concentric with the ring and is held from tipping off the ring by a plurality of rollers having flanged lower portions which ride below the inner lip of the ring. Selectively operated power means, such as a pair of driven rollers or driven pinions are journaled on the chassis at each end thereof and are positioned in driving engagement with the ring.

If road clearance is no problem when moving the crane between operating sites, the jacks may be raised above the level of the ground thereby lowering the wheels onto the ground and providing adequate road clearance so that the crane with ring attached by the flanged rollers (or equivalent structure) can be driven and set up at the next site.

If road clearance is a problem and the crane is to be moved long distances, one section of the ring is opened to permit the crane to be driven through the resulting gap in the ring out of the ring before the crane is moved to a new location. The boom and counterweight are preferably removed from the crane to minimize weight and to reduce the overall height of the vehicle before movement to the new location. These removed components are then transported by other means to the new site.

In order to be able to use both a relatively small diameter ring during normal operation of the crane and to comply with road laws of different governmental agencies, the crane chassis is preferably extendible and retractable. When the crane is in normal operation supported on the ring, the chassis is preferably fully retracted. When transporting the chassis over government controlled roads, the chassis may be extended to comply with road laws which allow vehicles with longer wheel bases to carry heavier loads.

BRIEF DESCRIPTION OF THE DRAWINGS

FIG. 1A is a plan of one of the longitudinally extending wheel base adjusting members of the chassis.

FIG. 2 is a diagrammatic plan with parts removed to illustrate the relationship of the crane chassis relative to the ring when in operative position, said view also illustrating a friction drive system adjacent each end of the chassis for rotating the chassis about the vertical axis of the ring.

FIG. 3 is an enlarged diagrammatic section taken along lines 3—3 of FIG. 2 illustrating one of the friction drive units of FIG. 2 with the crane being supported by the ring in operative position.

FIG. 3A is a view like FIG. 3, but showing the addition of a chain and sprocket drive system.

FIGS. 8, 9 and 10 are diagrammatic operational views respectively illustrating a crane being driven into the entrance opening of a ring at a working site, the ring being closed in chassis encompassing position, and the chassis being supported by the ring and rotated to a position out of alignment with its path of movement into the ring.

DESCRIPTION OF THE PREFERRED EMBODIMENT

Figure 1:
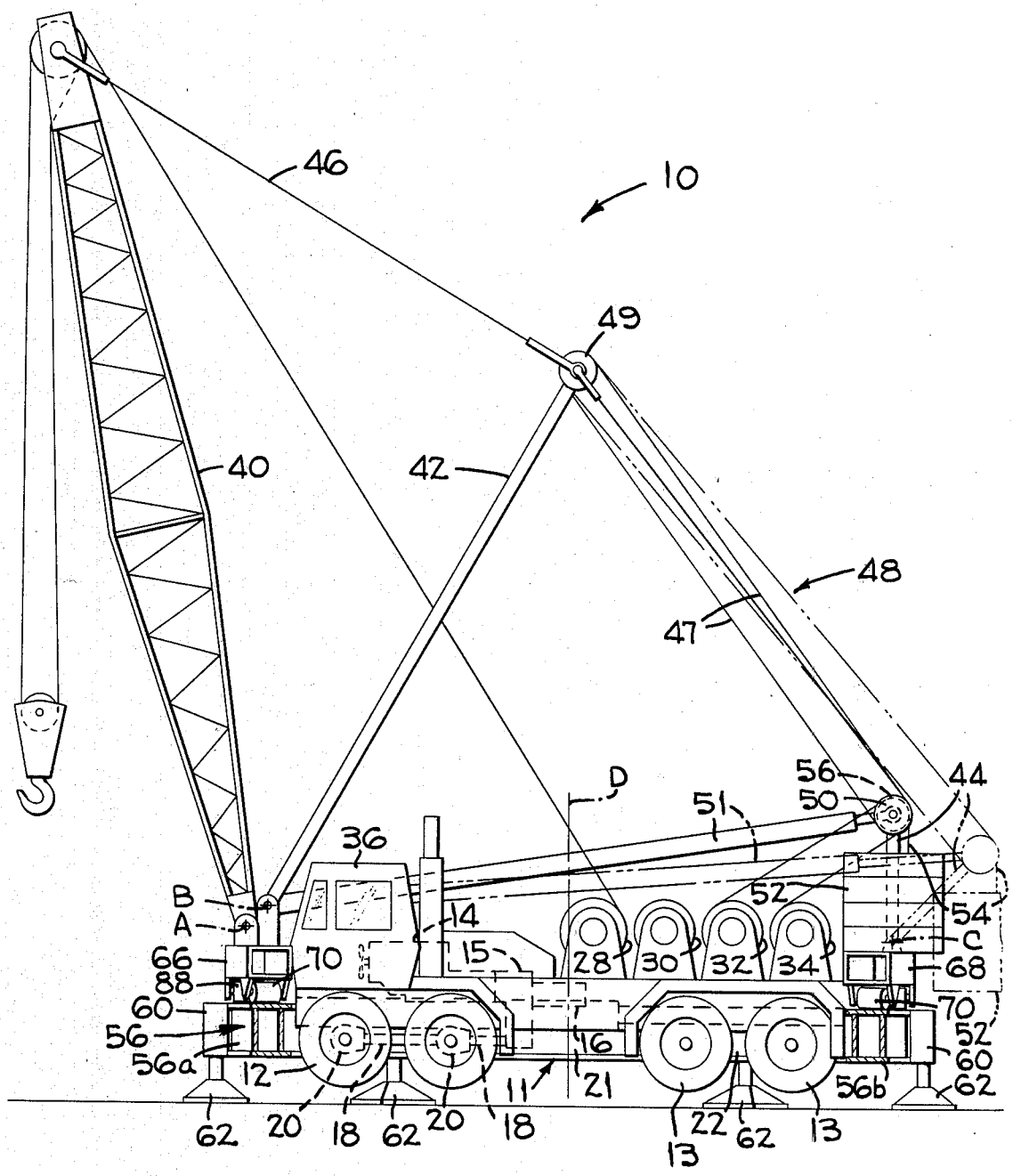
FIG. 1 is a diagrammatic side elevation of the ring supported truck crane of the present invention illustrated in its raised operative position, certain parts of the ring and chassis being cut away.

The ring supporting truck crane 10 (FIG. 1) of the present invention is illustrated as comprising a chassis 11 supported by front wheels 12 and rear wheels 13 journaled thereon with the pairs of front wheels 12 being steerable.

Power for the crane 10 is provided by an engine 14 which is preferably coupled to an automatic transmission 15 which drives hydraulic pumps 16. The automatic transmission also provides power to the front wheels 12 through a drive train, which drive train includes the usual drive shafts 18, universal joints and differentials 20.

The use of a front wheel drive as above described makes it possible to mount the rear wheels 13 on the chassis for adjustment longitudinally of the chassis for complying with varying state road laws which specify minimum permissible wheel bases for vehicles of specific weights traveling on the roads. In this regard, the wheel base may be adjusted forwardly or rearwardly about 8 feet by providing a pair of longitudinally extending, telescopic chassis frame members such as telescopic box beams 21,22 (only one being partially shown in FIGS. 1 and 1*a*). The front portion of the crane 10 is primarily supported on the front beams 21 and front wheels 12, while the rear portion of the crane is primarily supported on the rear beams 22 and rear wheels 13. The two telescopic beams 21,22 may be extended and retracted by hydraulic cylinders 23 (FIG. 1A) when the chassis is supported on the ground and is then locked in adjusted position by bolts 24 or the like.

Although the preferred power train is the above described front wheel drive, it will be understood that the crane may be driven by a standard manual shift, rear wheel drive, or by a hydraulically operated front wheel drive.

The hydraulic pumps 16 (FIG. 1) of a somewhat conventional hydraulic system (not shown in its entirety) provide hydraulic power to the wheel base cylinders 23; for several hydraulically driven winches 28,30,32 and 34; and for other hydraulic components which are controlled in a conventional manner by an operator when seated within a single cab 36.

A boom 40 and mast 42 are connected to the front end of a chassis 11 for pivotal movement about horizontal axes A and B, respectively; and a counterweight mast 44 is connected to the rear end of the chassis 11 for pivotal movement about an axis C.

The boom 40 is connected to the mast 42 by pendant 46. The boom and mast are pivoted about their horizontal axes A and B by a cable 47 of a boom hoist rigging 48, which cable is trained around sheaves 49 and 50 on the masts 42 and 44, respectively, and is powered by the winch 34.

A hydraulically operated telescopic strut 51 is pivotally connected between axis B and the upper end of the counterweight mast 44. The strut 51 normally acts as a stop to prevent the mast 44 from moving rearwardly of the solid line position in FIG. 1, but is hydraulically extended and retracted by the operator to move the mast 44 between the dotted and solid line positions when loading and unloading a counterweight 52. The counterweight 52 is moved between the two positions by the telescopic strut 51 aided by a cable 54 which is connected to the counterweight 52. The cable 54 is trained around a sheave 56 on the counterweight mast 44 and is wound on the drum of the winch 32. Boom stops (not shown) and the counterweight strut 51 prevent the boom from pivoting rearwardly and prevent the counterweight stop from pivoting forwardly of their illustrated solid line positions in FIG. 1.

It will be understood that the forward portion of the counterweight 52 conforms to the concave curvature of a ring 56 and may also be cut away to provide clearance for the boom hoist cable 47 if necessary.

The ring 56 (FIGS. 2 and 8–10) is formed from a plurality of arcuate sections 56*a* that are rigidly secured together as by bolting. In the preferred embodiment, six sections are illustrated with one section 58*b* being removable to permit the crane chassis to be driven into or out of the ring as illustrated in FIG. 8. Each ring section 56*a* and the removable ring 56*b* has a jack 60 rigidly secured thereto, which jack includes a ground engaging foot 62. The jacks may be manual jacks or may be hydraulically operated jacks. The jack feet 62 are moved between an operative position elevating the ring to support the crane chassis 11 and wheels 12,13 entirely above the ground as illustrated in FIG. 1, and a transport position (FIGS. 7 and 8) lowering the ring so that the wheels 12,13 support the chassis 11.

Figure 7:
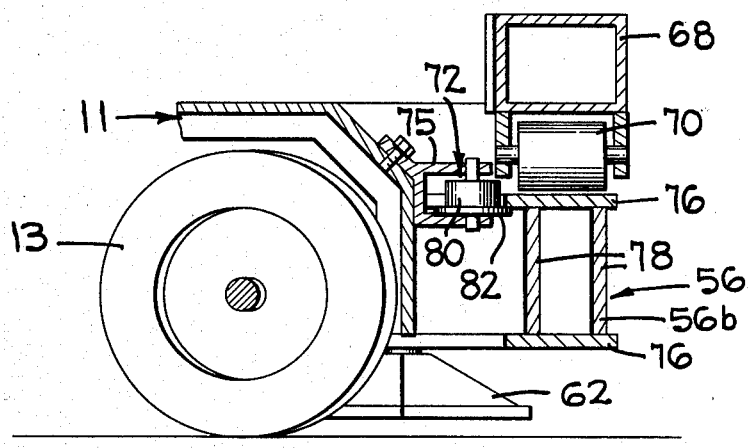
FIG. 7 is a diagrammatic section taken along lines 7—7 of FIG. 4 illustrating one of the chassis guiding and ring supporting flanged rollers on the rear of the chassis with the flanged rollers supporting the ring and with the chassis being supported on its wheels in transport position.

If the ring 56 is also supported by the chassis when in transport position and the jack feet 62 are raised above the ground as illustrated in FIG. 7, the ring may be transported by the chassis to a new site. If the ring 56 is not to be carried by the chassis, the section 56*b* is removed as illustrated in FIG. 8 and the lowered ring is supported on its feet until the chassis has been backed out of the ring. The several sections 56*a* are then disconnected and moved by trucks or the like to a new location.

In order to rotatably connect and center the vehicle chassis relative to the ring when in operative position, the chassis includes a front end portion 66 and a rear end portion 68 both of which overlie the ring 56. A plurality of rollers 70 are journaled on each of the end portions 66,68 for rotation on the upper surface of the ring thereby supporting the chassis 11 when the ring is raised into operative position as illustrated in FIG. 1.

The chassis 11 is maintained centered relative to the ring by a plurality of flanged rollers 72 (FIGS. 2, 6 and 7) which are connected to the chassis 11 by brackets 74,75 for rotation about vertical axes. The brackets 74 may be adjustably connected to the chassis by conventional adjustment means (not shown) in order to adjust the rollers radially of the ring.

Figure 6:
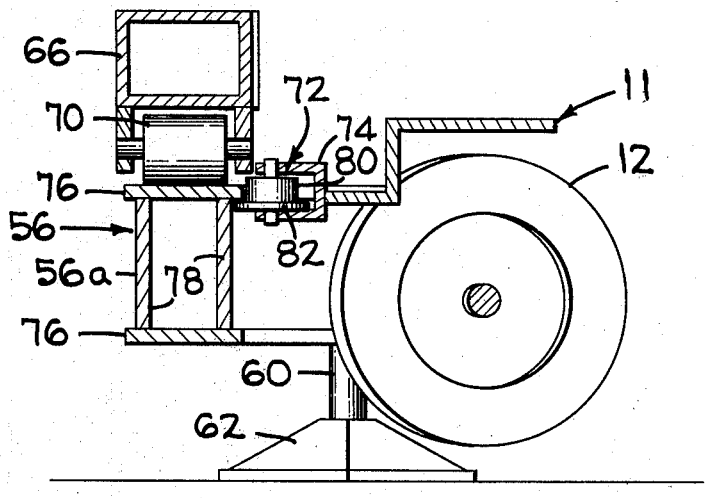
FIG. 6 is a diagrammatic section taken along lines 6—6 of FIG. 2 illustrating one of a plurality of chassis guiding and ring supporting flanged rollers.

As best shown in FIGS. 6 and 7, the ring 56 is of generally box shape having upper and lower annular members 76 which are secured to and extend outwardly of vertical members 78. Each roller 72 includes a cylindrical body 80 which rotatably engages the inner surface of one of the annular members 76, preferably the upper annular member, thus maintaining the chassis centered relative to the ring 56. Each roller 72 also includes a flange 82 which rides below the inner edge of one of the annular members 76 thus preventing an end portion of the chassis 11 from lifting off the ring during operation, and also providing means for supporting the ring on the chassis when the jacks are raised to transport position as illustrated in FIG. 7.

FIGS. 2 and 3 illustrate one type of drive system 84 for rotating the chassis about the vertical axis D of the ring during operation of the crane 10. The drive system 84 includes a pair of hydraulic motors 86 coupled to associated rollers 88 journaled on the end portion 66,68 of the chassis and bearing against the upper surface of the ring 56 with sufficient frictional force to drive the chassis around the axis D in either direction as selected by the operator.

A second type of drive system **84*a* is illustrated in FIG. 3A and is similar to the drive system 84 except an endless chain 89 is secured to the upper annular member 76*a* of the ring 56' and is engaged by a sprocket 90 secured to the roller 88*a***.

Figure 4:
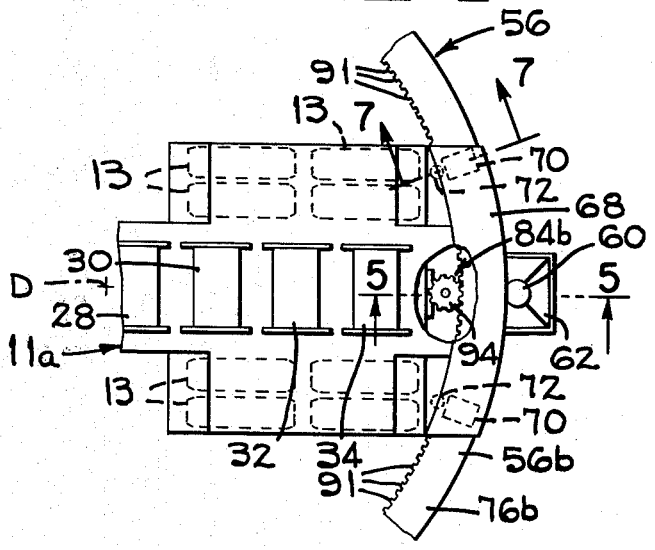
FIG. 4 is a diagrammatic plan of one end portion of the crane with parts cut away to illustrate one unit of a modified form of a drive system, which modified system is in the form of a pinion and ring gear.
Figure 5:
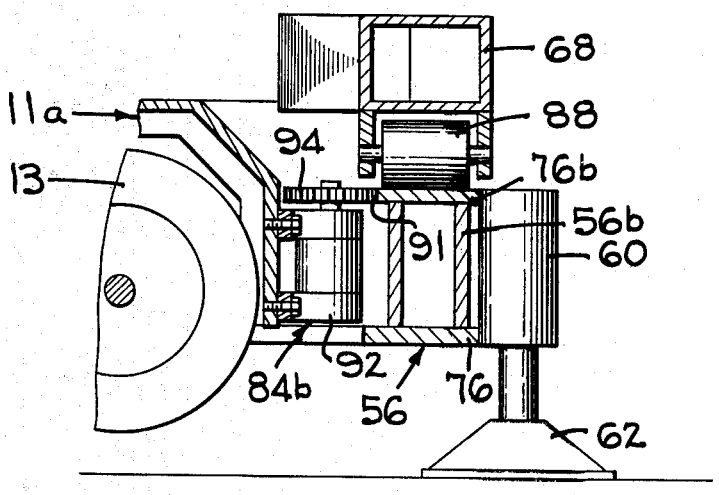
FIG. 5 is a diagrammatic section taken along lines 5—5 of FIG. 4 illustrating the drive unit of FIG. 4.

FIGS. 4 and 5 illustrate a third type of drive system **84*b* which includes internal gear teeth 91 on the inner surface of one of the annular members 76*b*, preferably the upper member. Vertically oriented hydraulic motors 92 (only one being shown) have pinions 94 secured to their shafts and meshing with the ring gear teeth 91. The motors 92 are mounted on both ends of the chassis to selectively drive the chassis 11*a* about the vertical axis D as determined by the crane operator. One or both of the hydraulic motors 92** may be mounted for radial adjustment relative to the ring by conventional means (not shown) to assure proper meshing of the pinions with the ring gear teeth.

In operation of the ring supported truck crane 10 of the present invention, the ring 56 is set up at a working site with one section **56*b* open as illustrated in FIG. 8 so that the chassis 11 and components supported thereon can be driven into centered position relative to the ring. The ring section 56*b* is then bolted in place as illustrated in FIG. 9, and the ring 56 is thereafter raised and leveled by the jacks 60 until the chassis 11 is entirely supported by the ring through the rollers 70 with the wheels 12,13 lifted off the ground as illustrated in FIG. 1. The entire chassis 11 is then in position to be rotated about the vertical axis D (FIG. 10) of the ring 56 by selective actuation of the particular drive system 84,84*a* or 84*b* that is installed on the chassis. During operation the flanged rollers 72** maintain the chassis centered with the ring and prevent disengagement of the chassis from the ring.

Prior to placing the crane in operation, the boom 40 (if not already assembled on the chassis) is connected to the front end of the chassis 11 for pivotal movement about horizontal axis A and is connected to the winch 34 by pendant 46 and cable 47. The counterweights 52 are then lifted onto the rear end of the crane by controlled actuation of the winch 32 and the hydraulically extendible and retractable strut 51 as previously described.

After the work has been completed at the operating site, the counterweight is removed and the jacks 60 are lowered until the chassis 11 is supported on the wheels 12,13. If road clearance is no problem the crane, with the ring 56 attached thereto by the flanged rollers 72 and with the feet 62 raised to the FIG. 7 position, is driven as a unit to another site. The jacks 60 are then lowered to raise the chassis from the ground and the counterweight 52 is placed on the rear end of the chassis 11 by the strut 51 and winch 32 to place the crane in operative position at the new site.

If road clearance is a problem, the counterweight 52 is lowered to the ground by the strut 51 and winch 32 at a point between two of the jacks 60, the chassis 11 is pivoted into alignment with the ring section **56*b*, the ring is lowered by the jacks 60 sufficiently to permit the chassis 11 to be supported on its wheels, and the section 58*b* is removed from the ring 56 which remains supported on the ground by the jacks 60. The chassis 11** is then backed through the gap in the ring.

If the crane is to be moved long distances, the boom 40 is removed from the chassis 11. The boom, counterweight, and ring sections are transported to the new location by a truck or the like; and the remaining portion of the crane is driven to the new location by the operator. If the weight of the crane is such that road laws require the wheel base to be extended, the bolts 24 (FIG. 1A) are removed, the telescopic beam sections 21 and 22 are extended sufficiently to provide an acceptable wheel base, and the beam sections are then bolted in their new positions. In a crane having a thirty-three foot maximum wheel base, the telescopic beam sections 21,22 permit about eight feet of wheel base adjustment.

In the specification and claims the term "ground" is to be understood to include any surface capable of supporting the ring or wheels; which surfaces include concrete slabs, paved surfaces, or the deck of a barge or the like.

Although the best mode contemplated for carrying out the present invention has been shown and described it will be apparent that modification and variation may be made without departing from what is regarded to be the subject matter of the invention.

I claim:

1. A self-propelled ring supported truck crane comprising a chassis mounted on ground engaging transporting members and supporting a boom for pivotal movement relative to said chassis only about a horizontal axis, means defining a ring having a vertical axis, ground engageable jack means connected to said ring for moving said ring between an inactive position spaced below said chassis and an active position supporting said chassis, rotatable means interposed between said chassis and said ring means for rotatably supporting said chassis on said ring when said jack means elevates said ring sufficiently to lift the chassis and transporting members clear of the ground, and selectively operable drive means interconnecting said chassis with said ring for rotating said chassis about said vertical axis.

2. An apparatus according to claim 1 and additionally comprising means interconnecting said ring and said chassis for movement of said ring with said chassis to a new site when said chassis is supported on said transporting means and said jack means are raised from the ground.

3. An apparatus according to claim 1 and additionally comprising rotary interconnecting means connecting said ring and said chassis for centering said chassis relative to said ring and for permitting relative rotation of said chassis relative to said ring when interconnected.

4. An apparatus according to claim 2 or 3 wherein said ring includes a circular peripheral edge, and wherein said rotary interconnecting means are a plurality of flanged rollers journaled on said chassis equidistant from said vertical axis with the body of each of said rollers riding against said peripheral edge and with the flange of each of said rollers riding under said peripheral edge.

5. An apparatus according to claims 1 or 2 wherein said chassis supporting rotatable means are a plurality of rollers journaled on said chassis and positioned to ride on said ring when said ring is in said active position.

6. An apparatus according to claims 1 or 2 wherein said selectively operable drive means includes a plurality of drive rollers journaled on said chassis and positioned to frictionally engage said ring, and power means operatively connected to said drive rollers for rotating the rollers and chassis in selective directions relative to said ring.

7. An apparatus according to claims 1 or 2 wherein said selectively operable drive means includes means defining a ring gear on said ring, a plurality of pinions journaled on said chassis and positioned to drivingly engage said ring gear, and power means operatively connected to said pinions for rotating the pinions and chassis in selected directions relative to said ring.

8. An apparatus according to claims 1 or 2 wherein said selectively operable drive means includes means defining an annular chain secured to said ring, a plurality of sprockets journaled on said chassis and positioned to drivingly engage said chain, and power means operatively connected to said sprockets for rotating the sprockets and chassis in selected directions relative to said ring.

9. An apparatus according to claim 1 wherein said ground engaging transporting means are wheels.

10. An apparatus according to claims 1 or 2 wherein said ring is formed from a plurality of interconnected sections and is initially placed in its inactive position at a working site with one of said sections open to permit the chassis to be driven into centered position relative to said ring prior to closing said ring by securing said one section in place.

11. An apparatus according to claims 1 or 2 wherein the chassis includes a front end and a rear end, said boom being supported on the front end of the chassis; and additionally comprising a counterweight, and counterweight transfer means on said chassis for transferring said counterweight between a position supported on the ground and a position supported on the rear end of said chassis.

12. An apparatus according to claims 1 or 2 wherein the chassis includes a front end, said boom being supported on the front end of said chassis; and additionally comprising a counterweight, means defining a counterweight mast pivoted to the rear end of said chassis, power means on said chassis connected to said counterweight mast for changing the elevation of said counterweight and for pivoting said mast and counterweight for transferring said counterweight between a position supported on the ground and a position supported on the rear end of said chassis.

13. An apparatus according to claim 12 wherein said power means comprises a hydraulically extensible and retractable strut for pivoting said counterweight mast, and wherein said power means additionally comprises; winch means, a sheave journaled on said counterweight mast, and a cable trained around said sheave and connected to said winch means and said counterweight.

14. An apparatus according to claims 1 or 2 wherein said transport members include front steerable wheels; and additionally comprising means for longitudinally extending and retracting said chassis;

when supported on said ring in a working mode, said chassis being retracted to provide a short wheel base for enabling support of said chassis on a relatively small diameter ring;

when being transported over roads and when the weight applied to the roads through the wheels exceeds the maximum permissible legal weight for the short wheel base, and said chassis and wheel base being extended a distance sufficient to satisfy the legal weight per wheel base requirements.

15. An apparatus according to claims 1 or 2 wherein said transport means include front steerable wheels and rear wheels, and wherein a drive train is provided on said chassis for driving said front wheels, said drive train comprising; an engine, an automatic transmission driven by said engine, and means for connecting said automatic transmission in driving engagement with said front wheels for driving said chassis along a road.

16. An apparatus according to claim 15 and additionally comprising means for longitudinally extending and retracting said chassis;

when supported on said ring in a working mode, said chassis being retracted to provide a short wheel base for enabling support of said chassis on a relatively small diameter ring;

when being transported over roads and when the weight applied to the roads through the wheels exceeds the maximum permissible legal weight for the short wheel base, said chassis and wheel base being extended a distance sufficient to satisfy the legal weight per wheel base requirements.

17. An apparatus according to claims 1 or 2 and additionally comprising power driven boom hoist means on said chassis for raising and lowering the free end of said boom; said boom hoist means including a boom mast pivoted to the front end of said chassis, a pendant connecting the mast to said boom, a plurality of sheaves journaled on the upper end of said boom mast, a counterweight mast pivoted to the rear end of said chassis, a plurality of sheaves journaled on the upper end of said counterweight mast, and a boom hoist winch and rigging including a cable trained around one of said sheaves on said boom mast and one of said sheaves on said counterweight mast for selectively raising and lowering the upper end of said boom; means defining a load hoist carried by said chassis for supporting a load from the upper end of said boom; a counterweight; and counterweight transfer means on said chassis for transferring said counterweight between a position supported on the ground and a position supported on the rear end of the chassis.

18. A self propelled ring supported truck crane comprising a chassis mounted on ground engaging transport members and supporting a boom for pivotal movement about a horizontal axis, means on said chassis for raising and lowering the free end of the boom, means defining a ring having a vertical axis, ground engageable jack means connected to said ring for raising and lowering said ring, rotatable means interposed between end portions of said chassis and said ring means for rotatably supporting said chassis on said ring when said jack means elevates said ring sufficiently to lift the chassis and transporting members clear of the ground, selectively operable drive means interconnecting said chassis with said ring for rotating said chassis about said vertical axis, and means interconnecting said ring and said chassis for movement with said chassis to a new site when said chassis is supported on said transporting means and said jack means are raised from the ground.

19. A method of setting up and operating a self-propelled ring supported truck crane which includes a chassis and wheel assembly with a boom pivoted relative to the chassis only about a horizontal axis; said method comprising the steps of interconnecting several segments of the ring at a working site to define an incomplete ring having an access opening and a vertical axis, driving the chassis through the opening into the ring with one end thereof overlying a portion of the ring, closing the opening by securing at least one ring segment to the incomplete ring with said added segment underlying the other end of said chassis, rotatably supporting said chassis on said ring in response to raising said ring sufficiently to lift the chassis and wheel assembly free of the ground, and drivingly interconnecting said chassis and ring for rotating said chassis and boom in selective directions about said vertical axis.

20. A method according to claim 19 and additionally including the step of supportively interconnecting the completed ring to said chassis, lowering the ring and chassis until the chassis and ring are supported solely by said wheels, and driving said chassis with said ring attached to a new site of operation.

21. A method according to claims 19 or 20 and additionally including the steps of selectively extending or retracting said chassis and wheel base;

when in a working mode, said chassis being moved into retracted position for minimizing the diameter of a chassis supporting ring;

when in a transport mode for moving the chassis along a road when the weight applied to the road exceeds the maximum permissible legal weight for the short wheel base, said chassis and said wheel base being extended a distance sufficient to satisfy the legal weight per wheel base requirements.

22. A method according to claim 21 including the step of applying power to the front wheels for moving the vehicle on the road when in its transport mode.

* * * * *